United States Patent [19]

Chorba et al.

[11] 4,119,320

[45] Oct. 10, 1978

[54] THREE DIMENSIONAL GAME

[76] Inventors: Mary Claire Chorba, 228 Bleecker St.; Peter Craig, 42 Bank St., both of New York, N.Y. 10014; Kurt Pierce Westergren, 173 Sullivan St., New York, N.Y. 10012

[21] Appl. No.: 803,969

[22] Filed: Jun. 6, 1977

[51] Int. Cl.[2] ..... A63F 3/00

[52] U.S. Cl. ..... 273/241; 273/271; 273/288

[58] Field of Search ..... 273/130 AC, 130 B, 136 E, 273/241, 271

[56] References Cited

U.S. PATENT DOCUMENTS

| | | | |
|---|---|---|---|
| 2,485,143 | 10/1949 | Duncan | 273/271 X |
| 3,556,526 | 1/1971 | Currie | 273/241 X |
| 3,561,774 | 2/1971 | Brinser | 273/130 AC |
| 3,695,614 | 10/1972 | Brisson | 273/130 AC |

*Primary Examiner*—Anton O. Oechsle
*Attorney, Agent, or Firm*—Howard N. Aronson

[57] ABSTRACT

A game including a base, nine elongated pegs disposed substantially perpendicularly to the base and arranged on the base in spaced relation in three discrete groupings. There is further provided a plurality of pieces each having a hole therethrough which is adapted to accommodate any one of the pegs. The game is readily adaptable to various types of scoring and hence, the present invention provides a game which may be played at various degrees of difficulty. In one embodiment, the pieces are provided in two sets of equal number and contrasting colors and an extra "wild" piece of a third discrete color is also provided. In a further embodiment, the pieces in the two sets are selectively provided with additional first, second and third indicia to subdivide each of the sets into three subsets. Prior to the start of the game, the "wild" piece is preferably randomly assigned to one of the two players and during the course of the game in which pieces of the two sets are alternately placed on the pegs, the "wild" piece may be so placed and allowed to represent any given indicia.

18 Claims, 5 Drawing Figures

FIG. 1
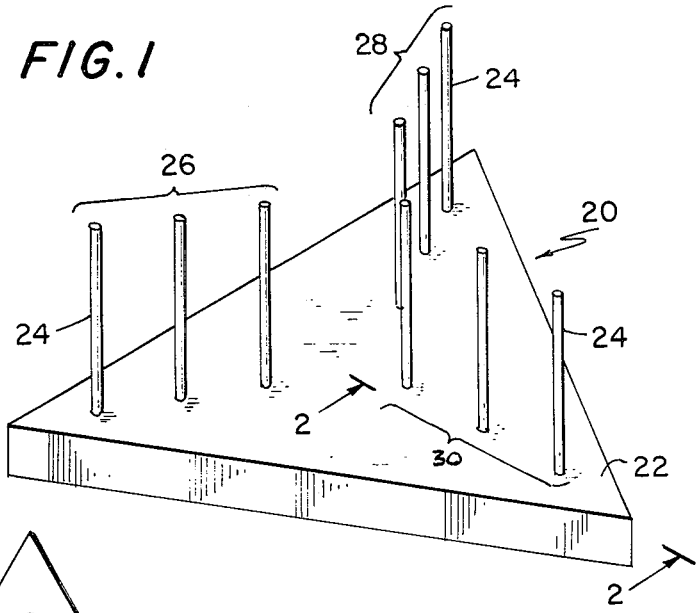
FIG. 3
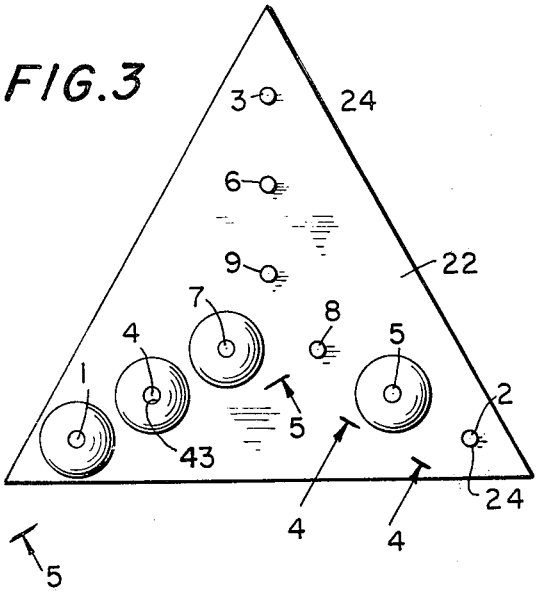
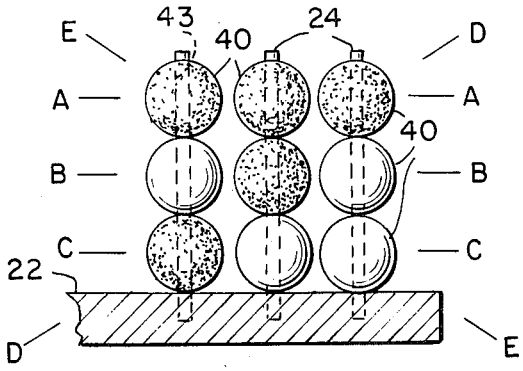
FIG. 2
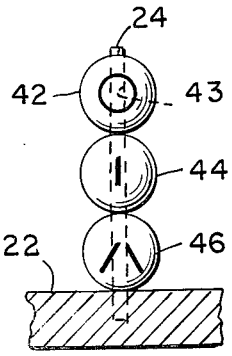
FIG. 4
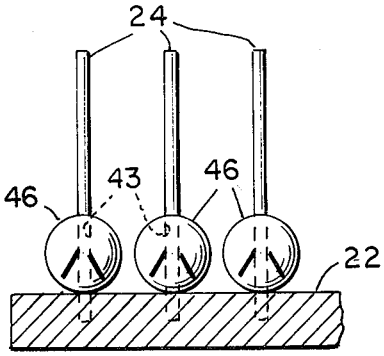
FIG. 5

THREE DIMENSIONAL GAME

BACKGROUND OF THE INVENTION

1. Field of the Invention

The present invention relates broadly to a novel three dimensional game which is readily adaptable to varying degrees of difficulty, and more particularly to a game having a plurality of pieces which may be disposed on nine pegs which are arranged on a base substantially perpendicularly to the base. The game made in accordance with the present invention is especially adapted to be played by two players and is further suited for various degrees of difficulty based upon the type of scoring being utilized. The invention therefore provides for increased difficulty as the players desire. The arrangement of the pegs on the base provides a basis for the consecutive disposition of three playing pieces of the same color or type in numerous patterns or directions based on color as well as indicia.

2. Description of the Prior Art

Three dimensional board games are known and usually comprise two or more playing fields or discrete separated layers which may be interrelated for scoring purposes by the players. Furthermore, games have been devised which incorporate disposing pieces in a continuous linear fashion within one of several various levels.

In the past, pins or pegs and the like have been utilized to receive playing pieces. However, prior art games are generally adaptable to only one type of playing procedure and accordingly, are not readily adaptable to various and varying games of difficulty.

SUMMARY OF THE INVENTION

The present invention overcomes the disadvantages of the prior art games by providing a base, nine elongated pegs or pins disposed substantially perpendicularly to the base and arranged on the base in spaced relation in three discrete groupings. A plurality of pieces are provided each having a hole therethrough wherein the hole is large enough to accommodate any one of the pegs. The pieces may be of various colors and have one of several different types of indicia thereon adapting the present invention to a plurality of rules with varying degrees of difficulty based on the type of scoring utilized in association with each game. However, the basic structure of the game features a board providing a plurality of receiving pegs whereby pieces of the same color may be disposed by the same player in a plurality of consecutive positions defining a straight line or a triangle.

It is an object of the present invention to provide a game which may be readily adaptable to various playing rules or procedures of play of differing degrees of difficulty.

It is a further object of the present invention to provide a game having a plurality of pieces whereby the pieces are divided into substantially two groups whereby a game for two people is provided. Furthermore, it is an object and within the scope of the present invention to provide indicia on some of the playing pieces whereby the indicia may be ignored whereby the players would utilize the overall shape or color to designate sets of pieces, or the indicia recognized and utilized for scoring purposes to increase the degree of difficulty of the game being played.

It is still yet another object of the present invention to provide a game which lends itself to an infinite number of playing variations.

Still further objects and features of this game reside in the provision of a game that is simple in construction, and inexpensive to manufacture, thereby permitting wide use and distribution.

These, together with the various ancillary objects and features of the invention which will become apparent as the following description proceeds, or obtained by the three dimensional game, preferred embodiments of which are shown in the accompanying drawing, by way of example only, wherein:

BRIEF DESCRIPTION OF THE DRAWING

FIG. 1 is a perspective view of the game made in accordance with the present invention;

FIG. 2 is a partial vertical cross-sectional view taken along the plane of line 2—2 in FIG. 1 depicting additionally a plurality of playing pieces disposed on the pegs;

FIG. 3 is a top plan view of the present invention;

FIG. 4 is a partial vertical sectional view taken along the plane of line 4—4 in FIG. 3; and FIG. 5 is a partial vertical sectional view taken along the plane of line 5—5 in FIG. 3.

DETAILED DESCRIPTION OF THE INVENTION

With continuing reference to the accompanying drawing wherein like reference numerals designates similar parts throughout the various views, reference numeral 20 is used generally to designate the three dimensional game of the present invention constructed in accordance with the concepts of the present invention.

The game includes a base 22 which may be of any desired shape such as the triangular shape depicted in FIG. 1. It is preferred that the base 22 be substantially flat and of any readily obtainable material such as plastic, metal, wood or cardboard and the like. Disposed on one side of base 22 in a predetermined pattern are nine elongated pegs 24 arranged in substantially equally spaced relation in three discrete groups 26, 28 and 30.

The elongated pegs 24 may be of any desired cross-sectional shape, preferably of a circular cross-section shape which is uniform along the length of each peg 24. The pegs may be attached permanently to said base 24 or may be removably affixed thereto. Furthermore, it is within the scope of the present invention that the pegs 24 and the base 22 be integral and of the same material, whereby such a structure would be readily produced by the use of injection molding of plastic, or the like.

The pegs 24 may be manufactured of any suitable material which is substantially rigid such as metal, plastic, wood or paper and the like. The pegs 24 could be adapted to be removably affixed to the base 22 by the use of screw threads (not shown) on the bottom of each peg 24 which are received in complementary threads formed in the base 22. However, it is intended that the pegs 24 may be retained in the base 22 by the use of an interference or pressure fit whereby the peg 24 is lodged in a depression or hole in the base 22. It will be readily understood that the pegs could also be driven into the base as for example if the pegs were metal and the base wood.

Each group of pegs 26, 28 and 30 is disposed on the base in substantially co-linear fashion, as will be readily apparent and is depicted in FIG. 3. Each grouping 26, 28 and 30, in the preferred embodiment being disposed at an angle to each other respective group. As shown in the drawing, the pins 24 in each group are disposed so that the outermost pegs 1, 2 and 3 in each group 26, 28 and 30 define an equalaterial triangle as well as the three innermost pegs 7, 8 and 9 and the three central pegs 4, 5 and 6. However, it is within the scope of the present invention that any two groupings such as for example groups 26 and 30 could be co-linear and the third grouping 28 at an angle thereto.

The pegs 24 are preferably of such a length such that the portion of each peg 24 which extends above base 22 is long enough to receive three playing pieces 40, but is not long enough to receive a fourth piece 40 thereon. The pegs are all preferably of substantially the same length.

The game further includes a plurality of pieces 40 which may be any desired shape or size, and in the preferred embodiment are spherical. There is a hole 43 which extends completely through each piece 40 and is of a cross-sectional size large enough to accommodate any one of the pegs 24. It is intended that the pieces may be readily and easily disposed on the pins as shown generally in FIG. 2. The game is intended to be used by disposing eventually three pieces 40 on each of the pegs as the respective players play.

The pieces 40 may be of any suitable material such as plastic, wood, metal or paper and the like, and may be of any shape such as a cubic, or of any irregular free form shape. However, the pieces all have a hole 43 therethrough so that they may be disposed on the pins 24.

The spacing of the pins 24 from one another is related to the size of the pieces 40 so that it is possible to dispose a piece on each of the nine pins 24 such that they will rest upon the base 22 without touching any of the other pieces, as depicted in FIG. 5. The spacing of the pins 24 does not have to be constant or equal but it is intended that they be of substantially evenly spaced, especially within each section 26, 28 and 30.

The game is adapted to be played with varying degrees of difficulty, by the use of pieces 40 which are of different colors and have various markings thereon. In one embodiment of the present invention, at least half the pieces are of one color, any color, and the remaining pieces, save one, of a different color which is idealy a contrasting color. The "one" piece just mentioned would be designated a "wild" piece and may be of a third discrete color. However, it must be understood, that the present invention includes the use of an equal number of pieces of each color and that a wild piece is not necessary.

In one embodiment of the present invention there is provided twenty-seven pieces 40, fourteen of which are of one color, such as white, and thirteen of a different and preferably contrasting color such as black. The pieces of one color are intended to be used by one player and the pieces of a second color by a second player.

In this embodiment of the game, the pegs are preferably arranged so as to create, in essence, a triangle shape as shown in FIG. 3. For use in describing how the game may be played, references is had to FIG. 3 wherein each of the pegs has been given a number designation one through nine. It will be noted that the outermost pins of each group have been designated 1, 2 and 3 the center pegs in this group 4, 5 and 6 and the innermost pins of each 7, 8 and 9. The game may be played so that the object is to form combinations of three consecutive pieces 40 which are disposed on the pins 24, the combinations being three pieces of one color lying along an imaginary line so that there is either a vertical disposition, such as three pieces of one color all on one peg; a horizontal disposition of pieces on three different pegs 24 which are all in one segment 26, 28 or 30, such as for example a piece disposed on each peg 3, 6 and 9 on one level. A level being a horizontal portion corresponding to the height of one piece such as is illustrated in FIG. 2. The line A-A in FIG. 2 showing a horizontal line which corresponds to the uppermost level of three horizontal positions. It is noted that in FIG. 2 there are three pieces 40 which are of the same color, in this particular instance black, lying along imaginary level A-A but that in imaginary levels B and C there are not three consecutive pieces of the same color. Furthermore, a consecutive disposition of pieces may comprise diagonal dispositions within a particular portion 26, 28 such as depicted by imaginary lines D-D or E-E. Furthermore, for the purposes of making a consecutive disposition three pieces could be disposed in a triangular relationship to form an equidistant triangle located within one horizontal plane A, B or C, as for example pieces disposed on the same level on pins 7, 8 and 9 or, for example, pins 1, 2 and 3.

It is within the scope of the present invention to have various types of scoring which is associated with different arrangements of consecutive pieces. For example, a player may be given one point if a horizontal consecutive disposition or arrangement is created as set forth above, and two points if a vertical disposition is made.

It is readily understood that any type of scoring arrangement can be devised or utilized and the game is especially adaptable to various types of scoring methods. It may be desired to associate either more, less or an equal number of points to a triangular disposition as opposed to a diagonal, horizontal or vertical disposition. The flexibility of scoring is exceedingly great due to the novel structure of the present invention.

It should be readily understood that as the structure of the present invention lends itself to various multiples of dispositions of three playing pieces the scoring associated therewith can be altered so that the degree of difficulty and the amount of skill and forethought required by each player can be altered and thereby create a game which may be altered with respect to skill or age.

In a preferred embodiment of the present invention it is contemplated that the players would play in alternating fashion such that each player disposes one of his or her pieces 40 on any peg whereby a piece 40 can be disposed on different pegs each time or on the same peg. It is contemplated that a point is scored every time a consecutive disposition of three pieces is formed such as a vertical disposition or the like as fully described above.

It must be appreciated that the game allows for both defensive and offensive playing whereby a piece 40 may be utilized to block another player from creating a consecutive disposition or a piece 40 may be used to help create or finish a consecutive disposition for the player in question. The player scoring the most points when all the pieces have been disposed on the board would be declared the winner.

In a further embodiment of the present invention some of the pieces 40 have in additional to a color at least one indicia thereon, as depicted for example in FIG. 5, wherein there are shown three white pieces. Piece 42 has a circle thereon, piece 44 has a vertical line thereon, and piece 46 has two lines which are at an angle to each other.

The indicia may be placed on as many pieces as desired to visually designated special pieces. The indicia may be applied to the desired pieces 40 by any suitable means which is compatible with the material which the pieces 40 are made of, as for example, the use of paint if a wooden piece is used and the use of a silkscreen process if a plastic piece is utilized.

In the preferred embodiment piece 42 has an indicia which may be considered as a head symbol, piece 44 bearing a body symbol, and the piece 46 bearing a symbol resembling feet whereby the vertical disposition of piece 42, 44 and 46 as shown in FIG. 5 would create a representation of a person. There are provided 27 pieces whereby there are thirteen dark pieces and thirteen light pieces, and one piece of a third discrete color which is considered a "wild" piece. Of the thirteen colored pieces corresponding to each player there is provided four pieces having a head symbol 42, four pieces having a torso or body symbol 44, and four pieces having the feet symbol 46. The indicia adapts the game so that the degree of difficulty can be significantly advanced. The players could toss a coin, or in some other manner decide who will be given the "wild" piece which can be used to represent any given colored piece with any given symbol or indicia. The scoring can be altered from the basic embodiment or maintained the same whereby based on color alone a three piece disposition as previously described is worth a given amount of points. However, if there is a vertical disposition corresponding to FIG. 5 wherein there is in descending order a head, torso and feet piece, additional points are earned. Furthermore, as depicted in FIG. 6 if three identical colored pieces bearing three identical indicia are disposed in any of the consecutive dispositions such as described above, a different point value would be earned.

It must be remembered that color as well as indicia can be brought into significance with respect to scoring and therefore pieces may be used based upon color as well as based upon the indicia.

As to possible scoring, when pieces of the same color have been disposed in a consecutive disposition of any sort it could count as one point. A vertical disposition of pieces of the same color as shown in FIG. 5 could be scored with three points, and a disposition such as depicted in FIG. 6, wherein three pieces of the same color bearing identical indicia have been disposed in a consecutive disposition could be scored as two points.

As may be readily appreciated the present invention is adaptable to an infinite number of variations with respect to scoring and therefore the degree of difficulty can be enhanced requiring exceptional forethought as well as perception to play.

A latitude of modification, substitution and change is intended in the foregoing disclosure, and in some instances some features of the present invention may be employed without a corresponding use of other features and still remain with the scope, spirit and intent of the present invention.

We claim:

1. A game comprising a base, nine elongated pegs disposed substantially perpendicularly to said base and arranged on said base in spaced relation in three discrete groups, a plurality of pieces each having a hole therethrough, said hole having a cross-sectional area large enough to allow any one of said pegs to pass entirely therethrough, half of said pieces, save one piece, being of one color comprising a first set of pieces, and the remaining pieces save said one being all of a different color defining a second set of pieces, wherein there are an equal number of pieces in said first set and said second set of pieces.

2. A game as in claim 1, wherein said one piece is a third discrete color.

3. A game as in claim 2, wherein each said set of pieces includes a first subset of four pieces, which four pieces in said subset have at least one first indicia thereon.

4. A game as in claim 3, wherein each said set of pieces further includes a second subset of four pieces, which four pieces in said second subset each has at least one second indicia thereon.

5. A game as in claim 4, wherein each said set of pieces includes a third subset of pieces, which four pieces in said third subset each has a third indicia thereon.

6. As game as in claim 5, wherein said first, second and third indicia are different.

7. A game as in claim 3, wherein said first indicia is substantially circular in shape representing a head symbol.

8. A game as in claim 4, wherein said second indicia is substantially elongated in shape representing a body symbol.

9. A game as in claim 5, wherein said third indicia is substantially U-shaped representing a feet symbol.

10. As game as in claim 1, wherein there are a total of 27 pieces, and each of said pieces is substantially spherical in overall shape.

11. A game as in claim 1, wherein said base is substantially in the shape of an equilateral triangle.

12. A game as in claim 1, wherein each piece is substantially the same overall size.

13. A game as in claim 12, wherein each peg is long enough to accommodate at least three pieces disposed vertically thereon.

14. A game as in claim 12, wherein each peg is dimensioned to accommodate only up to three pieces.

15. A game as in claim 1, wherein each discrete group of pegs includes three pegs which are disposed on said base substantially co-linearly.

16. A game as in claim 15, wherein at least one group of pegs is disposed at an angle to at least one other group of pegs.

17. A game as in claim 16, wherein each group is disposed at at least an acute angle with respect to each other.

18. A game as in claim 15, wherein each of said pegs are spaced from one another a distance sufficient to allow each peg to have disposed thereon a piece which engages said base.

* * * * *